United States Patent [19]

Tanikawa et al.

[11] Patent Number: 4,662,136

[45] Date of Patent: May 5, 1987

[54] PREFABRICATED CURTAIN WALL ASSEMBLY HAVING BOTH WINDOW AND SPANDREL UNITS

[75] Inventors: Shinji Tanikawa, Namerikawa; Koichiro Nawa, Kurobe, both of Japan

[73] Assignee: Yoshida Kogyo K. K., Tokyo, Japan

[21] Appl. No.: 686,539

[22] Filed: Dec. 26, 1984

[30] Foreign Application Priority Data

Dec. 28, 1983 [JP] Japan ..... 58-199299[U]
Dec. 28, 1983 [JP] Japan ..... 58-199300[U]

[51] Int. Cl.[4] ..... E04B 1/24

[52] U.S. Cl. ..... 52/235; 52/391; 52/489; 52/513

[58] Field of Search ..... 52/235, 388, 391, 430, 52/432, 506, 509, 512, 513, 484, 489, 485, 344, 348, 351

[56] References Cited

U.S. PATENT DOCUMENTS 4,423,576 1/1984 Farina et al. ..... 52/235

FOREIGN PATENT DOCUMENTS 2344429 3/1975 Fed. Rep. of Germany ..... 52/235
1174629 11/1958 France ..... 52/235

*Primary Examiner*—Carl D. Friedman
*Assistant Examiner*—R. Chilcot
*Attorney, Agent, or Firm*—Hill, Van Santen, Steadman & Simpson

[57] ABSTRACT

A curtain wall assembly composed of horizontal rows of prefabricated spandrel units mounted to respective floor systems of a building, and horizontal rows of prefabricated window units arranged alternately with and connected to the rows of spandrel units so as to enclose the open spaces between the floor systems. Each of the spandrel units and window units comprises a panel or panels and a generally rectangular frame supporting the panel or panels. Each spandrel unit further has an interior reinforcing frame through which it is coupled to the floor system. For firmly holding the window units against forces normal to the plane of the curtain wall assembly, a reinforcing stud is arranged vertically between any two adjoining window units and rigidly coupled to their opposed side frame members. Each reinforcing stud has its opposite ends anchored respectively to the reinforcing frames of the spandrel units underlying, and to those of the spandrel units overlying, the two window units between which the reinforcing stud lies. No direct connection of the window units to the floor systems is required.

9 Claims, 15 Drawing Figures

PREFABRICATED CURTAIN WALL ASSEMBLY HAVING BOTH WINDOW AND SPANDREL UNITS

CROSS-REFERENCE TO RELATED APPLICATIONS

The instant application relates to subject matter also disclosed in our co-pending applications: Ser. No. 686,537, filed Dec. 26, 1984, and entitled "Pre-Fabricated Curtain Wall Assembly"; Ser. No. 686,536, filed Dec. 26, 1984, and entitled "Pre-Fabricated Curtain Wall Assembly Having Both Window And Spandrel Units, And Method Of Installation"; and Ser. No. 686,542, filed Dec. 26, 1984, and entitled "Device For Mounting a Pre-Fabricated Curtain Wall Unit To A Floor Structure".

BACKGROUND OF THE INVENTION

Our invention relates to curtain walls of buildings, and more specifically to a prefabricated curtain wall assembly composed of vertically alternating rows of window units and spandrel units for attachment to the floor structure of a building, in particular of a multistory building.

A prefabricated curtain wall in the form of an array of discrete window units and spandrel units is per se not new in the art. Japanese Laid Open Patent Application No. 56-28956 represents a typical conventional example of prefabricated curtain wall which is perhaps most pertinent to our invention. This prior art curtain wall comprises horizontal rows of spandrel unit attached respectively to the floor systems of a building, and horizontal rows of window units arranged alternately with the rows of spandrel units so as to enclose the open spaces between the floor systems. Each window unit is attached at its top end to one floor system and is coupled at its bottom end to an underlying spandrel unit.

We favor the division of a curtain wall into separate window units and spandrel units, rather than into units each integrally comprising a window subunit and a spandrel subunit, as the separate window units and spandrel units are smaller in size, ligther in weight, and so easier of transportation and assemblage. We do, however, object to the direct attachment of the top end of each window unit to a floor system in accordance with the noted prior art. The direct mounting of not only the spandrel units but also the window units to a floor structure has made their installation very troublesome as the window units must also have had their vertical positions correctly adjusted with respect to the floor structure at the time of their mounting. As an additional disadvantage, having being directly coupled to the floor structure at their top ends only, the window units have not been so strong against forces normal to their own plane as can be desired.

Another factor that merits consideration in designing curtain walls having both window units and spandrel units of different sizes is the cross sectional construction of the frame members of such units. The strength and rigidity of these frame members greatly affect the strength and rigidity of the complete curtain wall assembly. Frame members of the same cross sectional shape and size are normally employed for both window and spandrel units of different sizes. The frame members of larger size units are of course longer, and therefore less in rigidity, than those of smaller size units. Without reinforcements, the complete curtain wall would then materially lessen in rigidity and strength, particularly against forces normal to its plane.

An apparent solution to this problem might be the use of frame members of different cross sectional constructions for the curtain wall units of different sizes. This solution would be unpracticable, however, as the frame members of different cross sectional shapes or sizes would increase the manufacturing cost of the curtain wall units. Such different frame members would also require correspondingly different means for assembling the curtain wall units and mounting them to the floors of a building. The frame members of the different curtain wall units should therefore be made equal in cross sectional construction as far as possible. Separate reinforcement means may advantageously be employed where necessary.

SUMMARY OF THE INVENTION

In view of the above problems left unsolved by the prior art, we seek to effectively reinforce the curtain wall assembly of the type under consideration and hence to make it possible to install the window units of the curtain wall assembly in position on a building without the need for the adjustment of their vertical position with respect to the floor structure. We have also found solutions to the problem of how to enhance the strength of the window units, as well as of the entire curtain wall assembly, against transverse loads.

Stated in brief, our invention provides an improved curtain wall assembly comprising a plurality of spandrel units to be mounted to each floor system of a building in side by side relationship with one another, and a plurality of window units each to be connected between two vertically adjoining ones of the spandrel units. Each of the spandrel units and window units comprises, in its simplest form, a panel and generally rectangular frame means supporting the panel. The curtain wall assembly further comprises a plurality of reinforcing studs each to be arranged vertically between any two horizontally adjoining window units and secured to opposed side frame members thereof. The opposite ends of each reinforcing stud are rigidly anchored respectively to the frame means of the spandrel units underlying the two window units between which the reinforcing stud lies, and to the frame means of the spandrel units overlying the two window units in question.

Preferably, as in a typical embodiment disclosed herein, the frame means of each spandrel unit comprises a main frame extending along and embracing the periphery of the panel, and a reinforcing frame arranged interiorly of the main frame and secured thereto. The opposite ends of each reinforcing stud are anchored to the reinforcing frames of the associated spandrel units.

Thus, in accordance with our invention, only the spandrel units are mounted directly to the floor systems whereas the window units are joined only to the underlying and overlying spandrel units. Only the spandrel units may therefore have their vertical positions adjusted correctly with respect to the floor systems at the time of their mounting. There is no need for the adjustment of the vertical positions of the window units with respect to the floor systems when they are subsequently connected between the spandrel units. The installation of the window units is much easier than if they were coupled directly to the floor systems as in the case of the prior art. Instead of being mounted directly to the floor systems, the window units have their side frame members rigidly fastened to the vertical reinforcing studs having their opposite ends anchored to the frame means of the spandrel units. So reinforced, the window units gain sufficient strength against transverse loading despite the fact that they are not directly mounted to the floor systems.

The spandrel units must themselves be of sufficiently strong construction for firmly supporting the window units via the reinforcing studs. In the preferred embodiment, therefore, each spandrel unit is provided with the noted reinforcing frame comprising top and bottom reinforcing frame members and a pair of side reinforcing frame members of rectangular arrangement. All these reinforcing frame members are of the same cross sectional shape and size, and additional vertical reinforcing members are secured to the side reinforcing frame members for the greater strength of the spandrel units.

The above and other features and advantages of our invention and the manner of realizing them will become more apparent, and the invention itself will best be understood, from a study of the following description and appended claims, with reference had to the attached drawings showing the preferred embodiment of our invention.

DESCRIPTION OF THE PREFERRED EMBODIMENT

General

Figure 1:
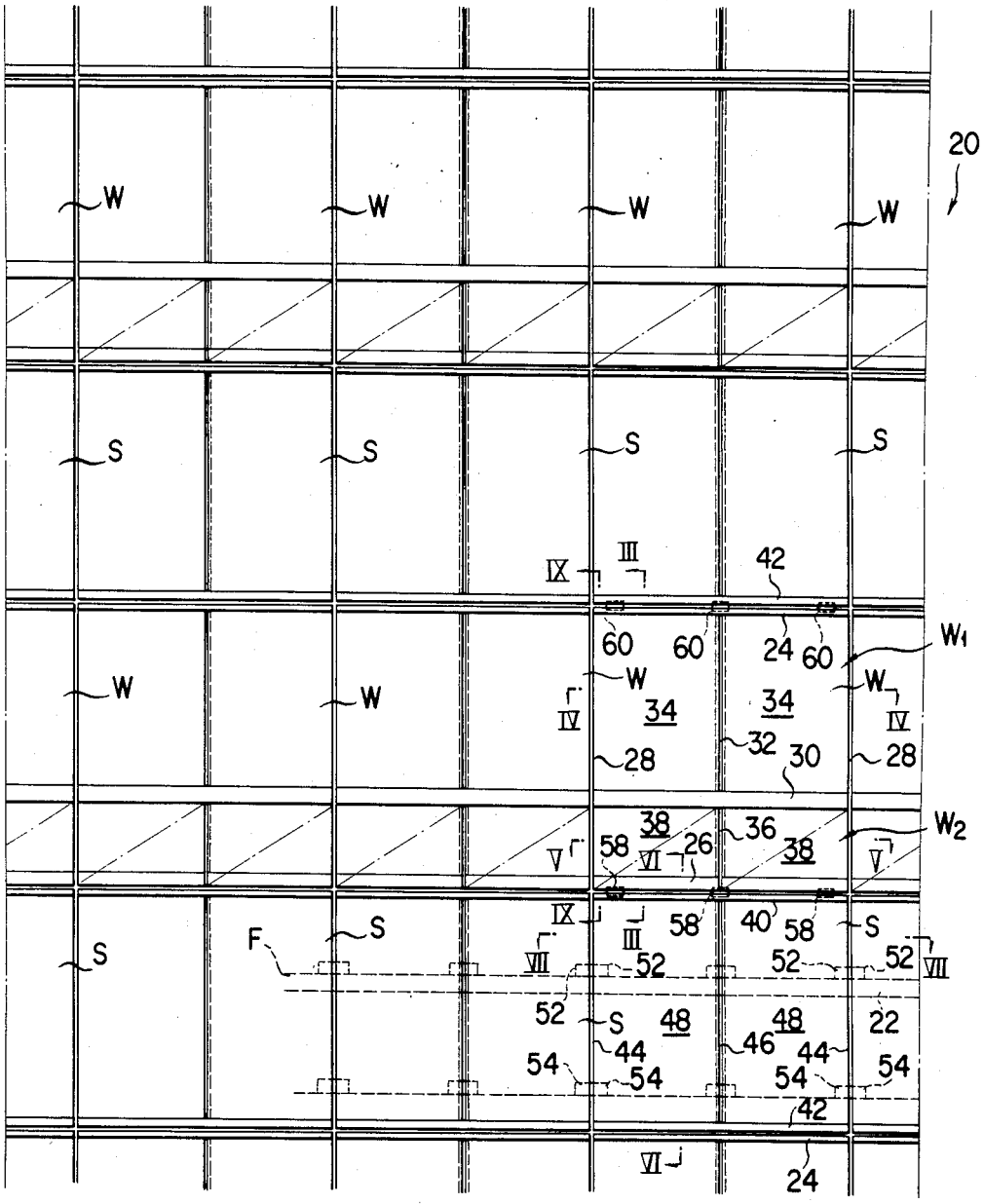
FIG. 1 is a partial exterior elevation of the prefabricated curtain wall assembly constructed in accordance with our invention, the curtain wall assembly being shown assembled and mounted in place on a building frame.
Figure 2:
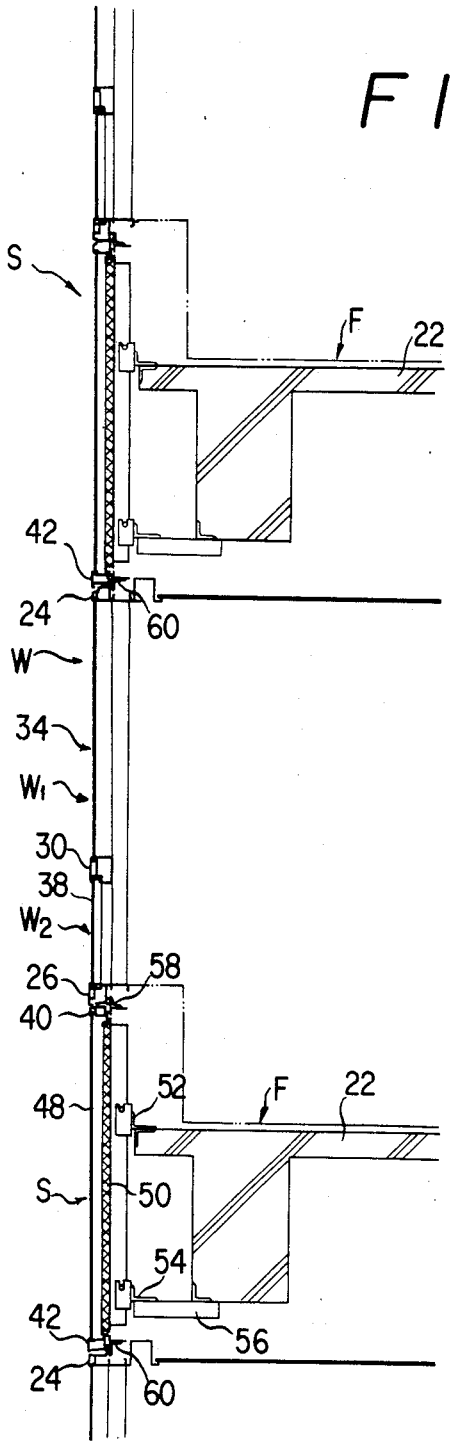
FIG. 2 is a vertical section, drawn on a slightly enlarged scale, through the curtain wall assembly of FIG. 1, the curtain wall assembly being shown together with the floor structure of the building to which it is mounted.

We have illustrated in FIGS. 1 and 2 the general organization of the typical curtain wall assembly in accordance with our invention as assembled and mounted in position on a multistory building. Generally identified by the reference numeral 20, the illustrated curtain wall assembly broadly comprises alternating horizontal rows of window units W and spandrel units S. Each row of spandrel units S is connected to one floor system F, including a slab 22, of the building. The rows of window units W are connected between the rows of spandrel units S so as to enclose the open spaces between the floor systems F.

Each window unit W is shown to comprise an upper, fixed window section W1 and a lower, top hinged sash window section W2 by way of example only. Each window unit W has a generally rectangular frame composed of a top rail or frame member 24, a bottom rail or frame member 26, and a pair of stiles or side frame members 28. Further a middle rail 30 extends horizontally between the frame members 28 to divide the window unit W into the upper fixed window section W1 and lower openable window section W2. An upper mullion 32 extends vertically between top frame member 24 and middle rail 30 to subdivide the fixed window section W1 into a pair of fixed window subsections having panes or panels of glass or other material 34 in side by side arrangement. A lower mullion 36 extends vertically between bottom frame member 26 and middle rail 30 to subdivide the openable window section W2 into a pair of openable window subsections having panes or panels of glass or other material 38 in side by side arrangement.

Each spandrel unit S likewise has a generally rectangular frame comprising a top rail or frame member 40, a bottom rail or frame member 42, and a pair of stiles or side frame members 44. A mullion 46 extends vertically between top frame member 40 and bottom frame member 42. The frame members 40, 42 and 44 and mullion 46 conjointly support a pair of panes or panels of glass or like material 48 and, on the inside of these panes or panels, a pair of relatively thick pieces of refractory board 50, as will be seen from FIG. 2.

We will hereinafter refer to the panes or panels of glass or like material 34, 38 and 48 as the panels for simplicity. Further, in this specification and in the claims appended hereto, we will use the terms "exterior" and "interior" to refer to the directions toward the outside and toward the inside, respectively, of the curtain wall assembly 20 in planes normal to the plane of the panels 34, 38 and 48. We will also use the terms "inner" and "outer" to refer to the directions toward and away from, respectively, the middle of each window unit W or spandrel unit S in the plane of the panels 34 and 38 or of the panels 48. Thus, for instance, the refractory board 50 of each spandrel unit S is arranged interiorly of the panels 48, and the rectangular frames of the window and spandrel units W and S are outward of their panels 34, 38 and 48.

FIGS. 1 and 2 further schematically illustrate the means for mounting the spandrel units S to the slabs 22 of the building, and the means for connecting the window units W to the spandrel units. Each spandrel unit S has its pair of side frame members 44 fastened to the top of the slab 22 by mounting means 52 and to the bottom of the slab by mounting means 54 via exterior extensions 56 of the slab. Each window unit W has its bottom end joined to the top end of the underlying spandrel unit S by connector means 58 and its top end to the bottom end of the overlying spandrel unit S by connector means 60. It will thus be seen that the window units W are not directly attached to the floor systems F of the building, but only through the spandrel units S.

The following is a more extensive discussion of the window units W, spandrel units S, reinforcements for these window and spandrel units, means for mounting the spandrel units to the floor systems F, connections between the window and spandrel units, and seals between the window and spandrel units. We will also describe in more detail the manner of mounting and assembling the complete curtain wall assembly 20.

Window Units

All the window units W are of like construction, so that we will describe only one of them in detail, it being understood that the same description applies to each of the other window units. We have illustrated in detail a vertical section through one representative window unit W in FIG. 3 and two different horizontal sections through the window unit in FIGS. 4 and 5.

Figure 3:
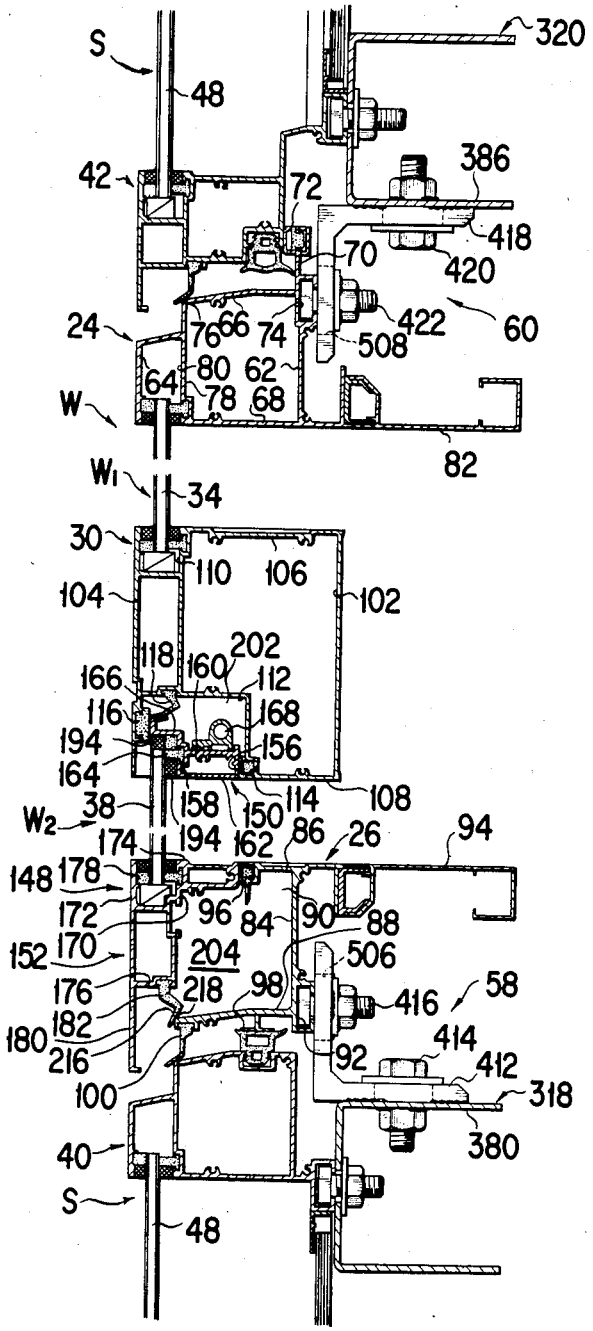
FIG. 3 is an enlarged vertical section, partly broken away for illustrative convenience, through the curtain wall assembly, taken along the line III—III in FIG. 1 and showing one of the window units and its joints with the overlying and underlying spandrel units.

FIG. 3 reveals that the top frame member 24 of the window unit W is hollow and approximately rectangular in cross section. It comprises an interior wall 62, exterior wall 64, top or outer wall 66, and bottom or inner wall 68. The interior wall 62 has an upward or outward extension 70 for carrying a continuous, horizontal sealing strip 72 for sealing engagement with the overlying spandrel unit S. The interior wall 62 also defines an undercut groove 74 opening interiorly. The top wall 66 is stepped to provide a corner 76 interiorly of the exterior wall 64. An additional vertical wall 78 coacts with the exterior wall 64 to define a downwardly opening peripheral gap 80 for engaging the upper peripheral portions of the panels 34. The bottom wall 68 has a top window stool 82 mounted thereto in a coplanar relation with each other.

As shown also in FIG. 3, the bottom frame member 26 of the window unit W has a vertical wall 84, top or inner wall 86, and bottom or outer wall 88, defining in combination an exteriorly and upwardly or inwardly open space 90. The vertical wall 84 defines an undercut groove 92 opening interiorly. The top wall 86 has a bottom window stool 94 mounted thereto in a coplanar relation with each other. The bottom window stool 94 is opposed to the top window stool 82 on the window unit top frame member 24. The top wall 86 has a sealing strip 96 mounted along its exterior edge. The bottom wall 88 has an abutment 98 of inverted T shaped cross section for sealing contact with the top frame member 40 of the underlying spandrel unit S. The bottom wall 88 further carries along its exterior edge a sealing strip 100 for sealing engagement with the spandrel unit top frame member 40.

Positioned intermediate the top frame member 24 and bottom frame member 26 of the window unit W, the middle rail 30 comprises an interior wall 102, exterior wall 104, top wall 106, and bottom wall 108. The top wall 106 is recessed along its exterior edge to provide an upwardly opening peripheral gap 110 for engaging the lower peripheral portions of the panels 34. The bottom wall 108 is also recessed along its exterior edge to provide a downwardly open space 112. This space has mounted therein interior and exterior sealing strips 114 and 116 and a top sealing strip 118.

Figure 4:
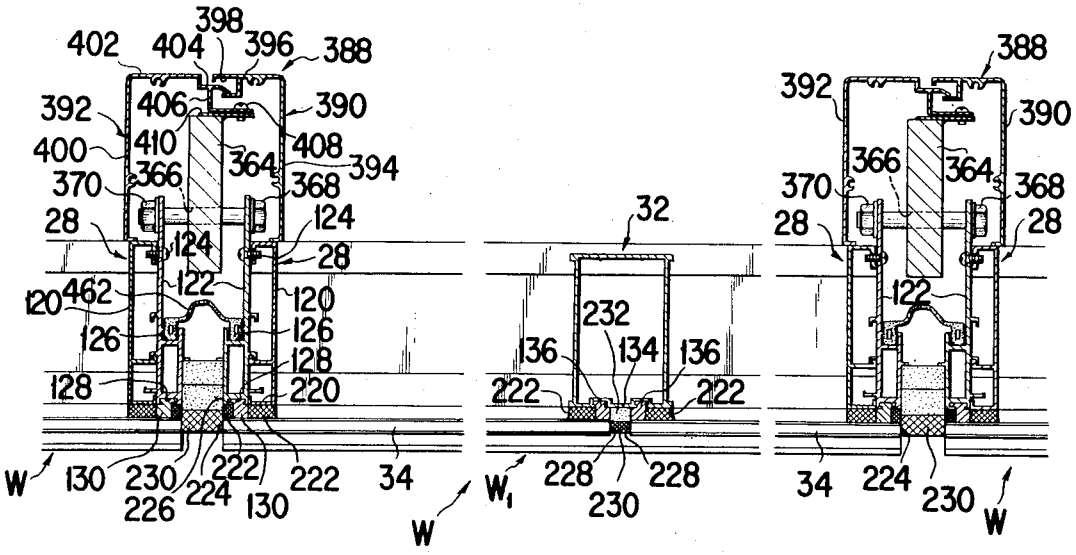
FIG. 4 is an enlarged horizontal section, partly broken away for illustrative convenience, through the curtain wall assembly, taken along the line IV—IV in FIG. 1 and showing the fixed window section of one of the window units and its joints with the fixed window sections of the neighboring window units.
Figure 5:
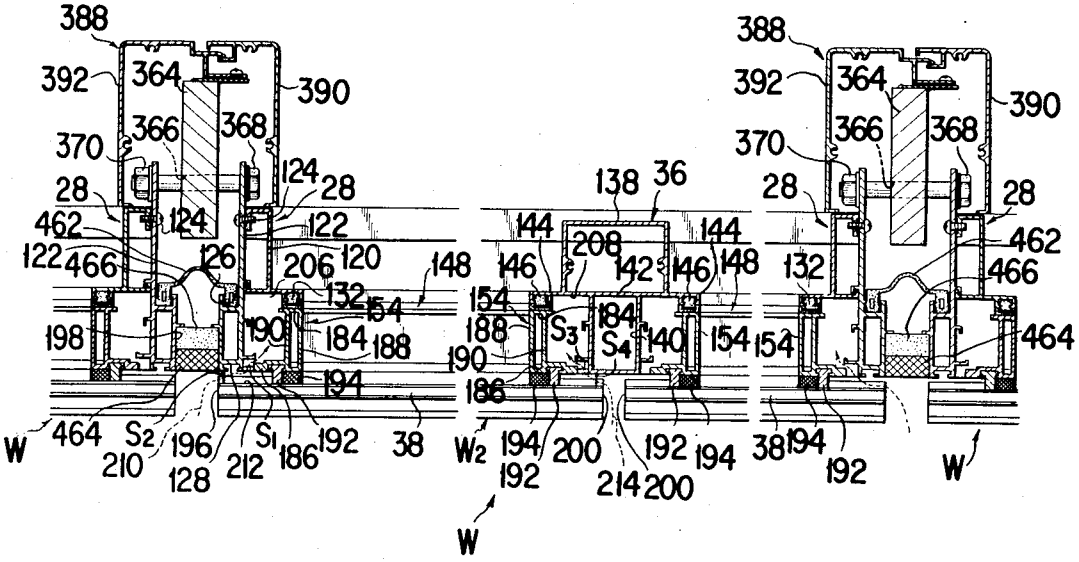
FIG. 5 is an enlarged horizontal section, partly broken away for illustrative convenience, through the curtain wall assembly, taken along the line V—V in FIG. 1 and showing the openable window section of one of the window units and its joints with the openable window sections of the neighboring window units.

Reference is directed to FIGS. 4 and 5 for the cross sectional configuration of the pair of side frame members 28 of the window unit W. Each side frame member 28 has an inner wall 120 and outer wall 122 interengaged and fastened together as by screws 124. The outer wall 122 defines an interiorly open groove 126 and an exteriorly open groove 128. The exteriorly open groove 128 has engaged therein a stuffing strip 130, FIG. 4, extending between top frame member 24 and middle rail 30. That portion of the inner wall 120 which extends between bottom frame member 26 and middle rail 30 is further adapted to carry a sealing strip 132 directed exteriorly.

As shown in FIG. 4, the upper mullion 32 of the window unit W is hollow and approximately rectangular in cross section. It includes an exterior wall 134 having defined therein a pair of undercut grooves for engaging respective stuffing strips 136.

The lower mullion 36 of the window unit W is seen in FIG. 5. It comprises an interior frame 138 and exterior frame 140, both of hollow, rectangular cross section, integrally joined together. A common wall 142 forming the boundary between the interior 138 and exterior 140 frames has a pair of outward extensions 144 each defining an undercut groove for engaging a sealing strip 146.

The reference numeral 148 in FIGS. 3 and 5 generally denotes a pair of top hinged sashes of the openable window section W2 of the window unit W. These sashes 148 are openably received in the respective rectangular spaces bounded by the bottom frame member 26, side frame members 28, middle rail 30, and lower mullion 36 set forth in detail in the foregoing. Each sash 148 comprises a top frame member 150, bottom frame member 152, and pair of side frame members 154, extending along the periphery of the panel 38 and joined to one another into generally rectangular shape. Preferably, the panels 38 of the openable window section W2 are panes of colored glass.

As seen in FIG. 3, the top frame member 150 of each sash 148 is accommodated in the downwardly open space 112 defined by the middle rail 30. The top frame member 150 comprises an interior wall 156, exterior wall 158, top or inner wall 160 and bottom or outer wall 162, combined into approximately rectangular cross sectional shape. The exterior wall 158 defines an undercut groove for engaging a stuffing strip 164 directed exteriorly. An approximately recumbent U shaped flange 166 is formed integral with the exterior wall 158 and extends generally exteriorly therefrom. Further the top frame member 150 of each sash 148 is provided with a pair of hinges 168 by which it is mounted to the one of the side frame members 28 and the lower mullion 36 for the swinging motion of the sash 148 about a horizontal axis.

The bottom frame member 152 of each sash 148 normally fits in the exteriorly and upwardly open space 90 defined by the bottom frame member 26 of the window unit W. The bottom frame member 152 comprises an interior wall 170, exterior wall 172, top or inner wall 174, and bottom or outer wall 176. The top wall 174 defines an upwardly or inwardly open gap 178 along its exterior edge. The exterior wall 172 has a downward extension 180 consealing the gap between the bottom frame member 26 of the window unit W and the top frame member 40 of the underlying spandrel unit S. The bottom wall 176 carries a sealing strip 182 of approximately V shaped cross section generally extending downwardly therefrom.

The pair of side frame members 154 of each sash 148, both seen in FIG. 5, each comprise an interior wall 184, exterior wall 186, inner wall 188, and outer wall 190, all joined into approximately rectangular cross sectional shape. The exterior wall 186 has a stuffing strip 192 attached thereto.

The panel 38 of each sash 148 has its lower marginal edge portion engaged in the gap 178 defined by the bottom frame member 152 and its upper and lateral marginal edge portions held respectively against the stuffing strip 164 on the top frame member 150 and against the stuffing strips 192 on the side frame members 154. Further the panel 38 is secured to the exterior wall 158 and flange 166 of the top frame member 150 and to the exterior walls 186 of the side frame members 154 by means of a relatively rigid adhesive such as a structural silicone sealant indicated at 194 in FIGS. 3 and 5.

As will be noted from FIG. 5, the outer vertical edge 196 of each panel 38 is in a coplanar relation with the exterior surface 198 of one of the side frame members 28 of the window unit W. The inner vertical edge 200 of each panel 38 is located approximately in the middle of the lower mullion 36 with respect to its transverse dimension.

Such being the construction of the openable window section W2 of each window unit W, each sash 148 when in the illustrated closed position defines an enclosed upper space 202 (FIG. 3) between its top frame member 150 and the middle rail 30 of the window unit W, an enclosed lower space 204 (FIG. 3) between its bottom frame member 152 and the bottom frame member 26 of the window unit W, an enclosed side space 206 (FIG. 5) between one of its side frame members 154 and one of the side frame members 28 of the window unit W, and another enclosed side space 208 (FIG. 5) between the other of its side frame members 154 and the lower mullion 36 of the window unit W. The side space 206 communicates with atmosphere by way of an air passageway 210 formed by a gap S1 between the exterior wall 186 of one of the side frame members 154 of the sash 148 and the exterior edge of the outer wall 122 of the side frame member 28 of the window unit W and by a gap S2 between the interior surface 212 of the panel 38 and the exterior edge of the outer wall 122 of the side frame member 28. The other side space 208 also communicates with atmosphere by way of an air passageway 214 formed by a gap S3 between the exterior wall 186 of the other side frame member 154 of the sash 148 and the exterior frame 140 of the lower mullion 36 of the window unit W and by a gap S4 between the interior surface 212 of the panel 38 and the exterior frame 140 of the lower mullion 36.

As will be seen from FIG. 3, the sealing strip 182 on the bottom frame member 152 of each sash 148 is bent at the middle of its transverse dimension. When the sash 148 is closed, the distal angled portion 216 of the sealing strip 182 is held against the exterior edge 218 of the outer wall 88 of the bottom frame member 26 of the window sash W.

Still further, when each sash 148 is closed, its frame is held against the sealing strip 96 (FIG. 3) on the bottom frame member 26 of the window unit W, the sealing strip 114 (FIG. 3) on the middle rail 30 of the window unit W, the sealing strip 132 (FIG. 5) on one of the side frame members 28 of the window unit, and the sealing strip 146 (FIG. 5) on the lower mullion 36 of the window unit. All these sealing strips are joined into a single continuous sealing strip.

As may have been seen from the foregoing, the noted enclosed spaces 202, 204, 206 and 208 around each sash 148 are at atmospheric pressure. Moreover, since the sealing strips 96, 114, 132 and 146 are continuous as aforesaid, the frame members 150, 152 and 154 of each sash 148 can be held both air and watertightly against the surrounding frame members 26, 28, 30 and 36 of the window unit. It is also noteworthy in connection with the openable window section W2 of the window unit W that the panels 38 of the sashes 148 substantially cover the side frame members 28 and lower mullion 36 of the window unit and further conceal the exterior ends of the air passageways 210 and 214 leading to the enclosed spaces 206 and 208 respectively. The exterior appearance of the curtain wall assembly 20 is thus enhanced aesthetically. An additional advantage of the above described construction of the openable window section W2 is that the top and side edges of the panels 38 are not too rigidly supported, so that they are not to easily break from vibrations as in the event of an earthquake. It will also be appreciated that the angled distal portion 216 of the sealing strip 182 functions as a water drip.

We will now go back to the description of the fixed window section W1 of the window unit W, with reference directed to both FIGS. 3 and 4. As illustrated in FIG. 3, each of the pair of panels 34 of the fixed window section W1 has its top and bottom peripheral portions engaged in the downwardly open gap 80 in the top frame member 24 and in the upwardly open gap 110 in the middle rail 30. Further, as seen in FIG. 4, the lateral marginal portions of each panel 34 are held against the stuffing strip 130 on one of the side frame members 28 and against one of the stuffing strips 136 on the upper mullion 32. These lateral marginal portions of each panel 34 are further secured to the exterior wall 220 of one of the side frame members 28, on both sides of the stuffing strip 130, and to the exterior wall 134 of the upper mullion 32 by means of an adhesive of relatively low elasticity such as a structural silicone sealant indicated at 222.

As will be seen also from FIG. 4, the outer vertical edge 224 of each panel 34 is in a coplanar relation with the outer surface 226 of one of the side frame members 28. The inner vertical edge 228 of each panel 34 is located approximately centrally of the upper mullion 32 with respect to its side to side transverse dimension. The opposed inner vertical edges 228 of the pair of panels 34, as well as the opposed outer vertical edges 224 of the panels 34 of the neighboring window units W, are joined by an adhesive of relatively high elasticity such as a silicone sealant indicated at 230. Seen at 232 is a backing strip of elastic material such as sponge filling the space bounded by the exterior wall 134 of the upper mullion 32, the pair of stuffing strips 136 thereon, and the adhesive 230. The backing strip 232 serves to prevent contact of the adhesive regions 222 and 230 with each other.

Thus, like the panels 38 of the openable window section W2, the panels 34 of the fixed window section W1 substantially conceal the pair of side frame members 28 and the upper mullion 32 for the enhancement of the aesthetic appeal of the curtain wall assembly 20.

Spandrel Units

The spandrel units S of the curtain wall assembly 20 are also of like construction, so that the description of one applies to each of the others. We will refer principally to FIGS. 6 and 7 for detailed description of one representative spandrel unit S.

As has been stated in connection with FIGS. 1 and 2, the spandrel unit S comprises the top frame member 40, bottom frame member 42, pair of side frame members 44, and mullion 46, as well as the pair of panels 48 and pair of refractory boards 40 supported by the frame members. We have illustrated in further detail the top 40 and bottom 42 frame members in FIG. 6 and the side frame members 44 and mullion 46 in FIG. 7.

The top frame member 40 of the spandrel unit S comprises an interior wall 234, exterior wall 236, upper or outer wall 238, and lower or inner wall 240, joined into approximately rectangular cross sectional shape. The outer wall 238 has an undercut groove 242 defined therein to receive a sealing strip 244 directed outwardly therefrom for sealing engagement with the aforesaid abutment 98 on the bottom frame member 26 of the overlying window unit W. The outer wall 238 is further stepped to provide a corner 246 slightly interiorly of the exterior wall 236. The inner wall 240 is recessed along its exterior edge to provide a downwardly or inwardly open peripheral gap 248 in which there are engaged the upper peripheral portions of the panels 48. The inner wall 240 has an interior extension 250 terminating in an undercut groove 252 opening interiorly.

Figure 6:
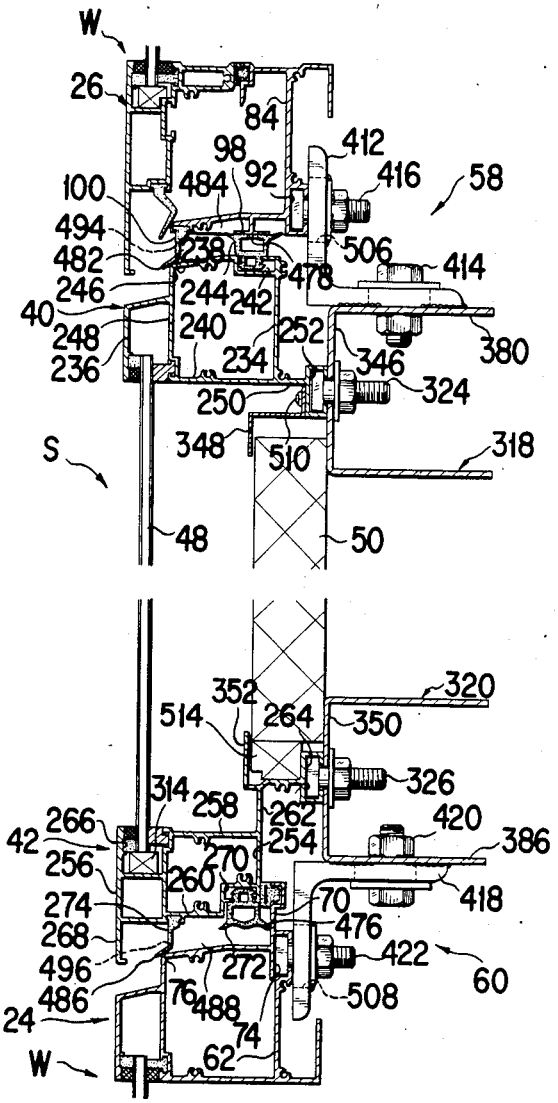
FIG. 6 is an enlarged vertical section, partly broken away for illustrative convenience, through the curtain wall assembly, taken along the line VI—VI in FIG. 1 and showing one of the spandrel units and its joints with the overlying and underlying window units.

As shown also in FIG. 6, the bottom frame member 42 of the spandrel unit S comprises an interior wall 254, exterior wall 256, upper or inner wall 258, and lower or outer wall 260, also combined into approximately rectangular cross sectional shape. The interior wall 254 has an upward or inward extension 262 defining an undercut groove 264 opening interiorly. The inner wall 258 defines along its exterior edge a peripheral gap 266 opening inwardly for receiving the lower peripheral portions of the panels 48. The exterior wall 256 has a downward or outward extension 268 covering the gap between the bottom frame member 42 of the spandrel unit S and the top frame member 24 of the underlying window unit W. The outer wall 260 defines along its interior edge an undercut groove 270 to support a sealing strip 272 for sealing engagement with the top frame member 24 of the underlying window unit W. The outer wall 260 also carries along its exterior edge another sealing strip 274 of approximately V shaped cross section for sealing engagement with the corner 76 of the underlying window unit top frame member 24.

Figure 7:
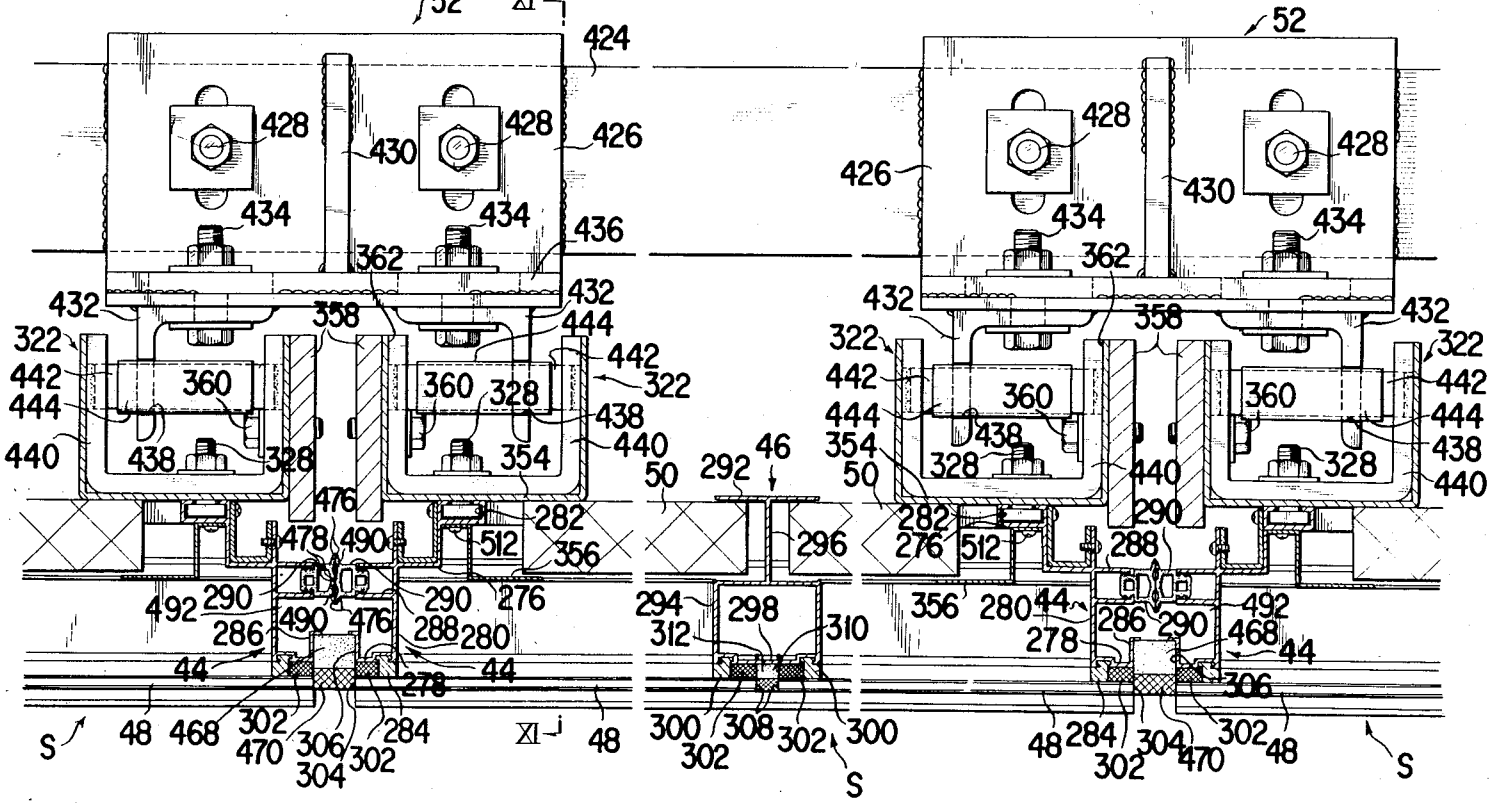
FIG. 7 is an enlarged horizontal section, partly broken away for illustrative convenience, through the curtain wall assembly, taken along the line VII—VII in FIG. 1 and showing one of the spandrel units and its joints with the neighboring spandrel units, the spandrel units being shown together with the upper mounting means for mounting the spandrel units to the floor structure of the building.

With reference to FIG. 7 the pair of side frame members 44 of the spandrel unit S each comprise an interior flange 276, exterior flange 278, and web 280 joining the flanges 276 and 278. The interior flange 276 defines an undercut groove 282 opening interiorly. The exterior flange 278 also defines an undercut groove engaging a stuffing strip 284 directed exteriorly and is further formed integral with an L shaped flange 286. The web 280 defines a further undercut groove 288 engaging a sealing strip 290 which is directed outwardly into sealing contact with a similar sealing strip 290 of the adjoining spandrel unit S.

As shown also in FIG. 7, the mullion 46 of the spandrel unit S comprises an interior flange 292, exterior frame portion 294 of hollow, rectangular cross section, and web 296 joining the interior flange 292 and exterior frame portion 294. The exterior wall 298 of the exterior frame portion 294 has a pair of undercut grooves defined therein to carry a pair of stuffing strips 300.

Each panel 48 of the spandrel unit S has its upper and lower peripheral portions engaged respectively in the gaps 248 and 266 in the top frame member 40 and bottom frame member 42, as seen in FIG. 6. Further, as depicted in FIG. 7, the opposite lateral marginal portions of each panel 48 are held against the stuffing strip 284 on one of the side frame members 44 and against one of the stuffing strips 300 on the mullion 46. FIG. 7 further indicates that the lateral marginal portions of each panel 48 are secured to the exterior flange 278 of one of the side frame members 44 and to the exterior wall 298 of the mullion 46 by an adhesive of relatively low elasticity such as a structural silicone sealant indicated at 302.

Mounted to the frame members 40, 42, 44 and 46 of the spandrel unit S as set forth above, each panel 48 has its outer vertical edge 304, FIG. 7, flush with the outermost surface 306 of one of the side frame members 44. The inner vertical edge 308 of each panel 48 lies approximately centrally of the mullion 46 with respect to its side to side transverse dimension. The opposed inner edges 308 of the pair of panels 48 are bonded to each other by an adhesive 310 of relatively high elasticity. A backing strip 312 of sponge or like elastic material prevents the contact of the strips of adhesives 302 and 310 with each other.

Thus, in each spandrel unit S, too, the pair of panels 48 substantially conceal the pair of side frame members 44 and the mullion 46 to make the exterior appearance of the curtain wall assembly 20 attractive. It will also be appreciated that each panel 48 has its upper and lateral marginal portions not too rigidly attached to the frame members 40, 44 and 46 and merely has its lower edge resting on the bottom frame member 42 via bearing blocks seen at 314 in FIG. 6. The panels 48 will therefore not easily break as in the event of an earthquake.

Spandrel Unit Reinforcements

Figure 8:
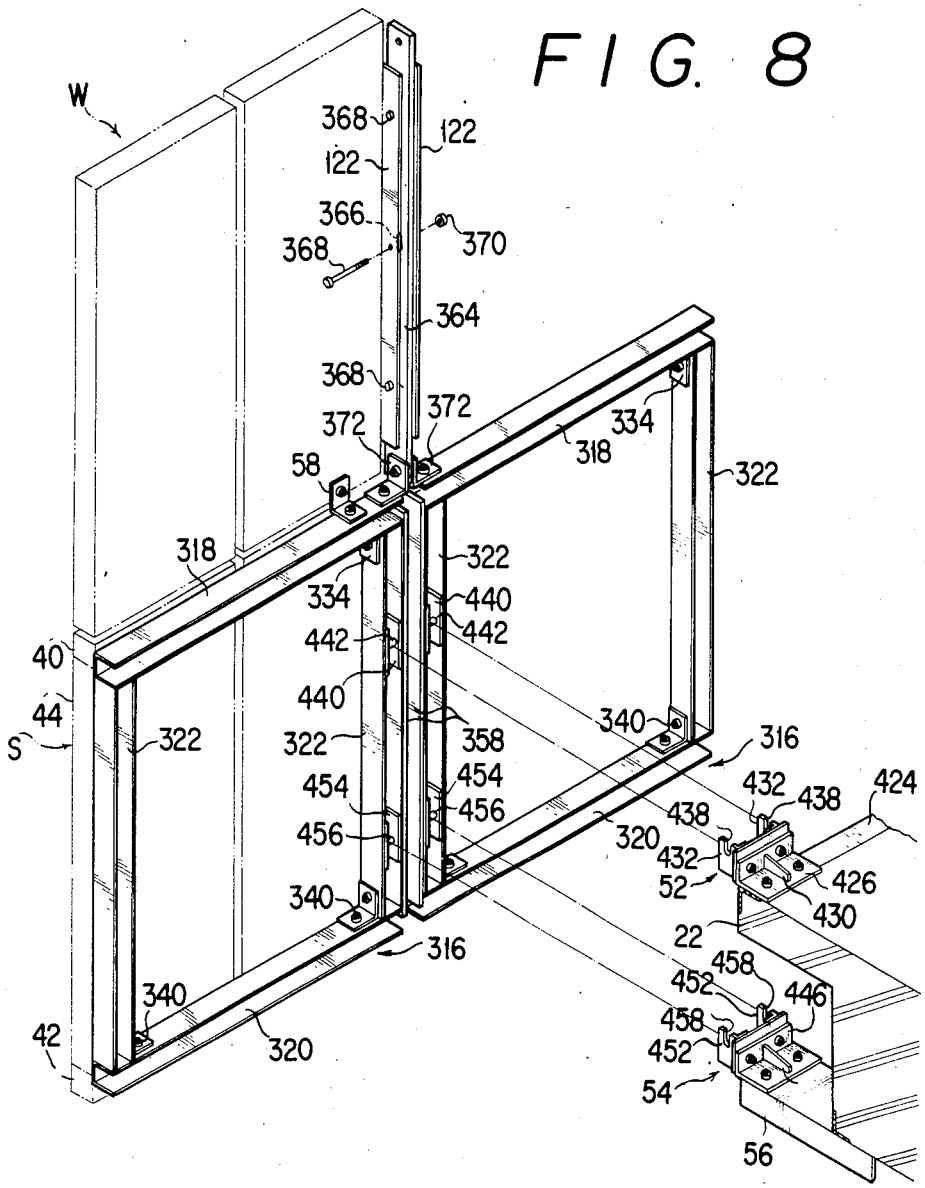
FIG. 8 is a perspective view showing the reinforcements for the window units and spandrel units, and the upper and lower mounting means for mounting the spandrel units to the floor structure of the building.

As best illustrated in FIG. 8, each spandrel unit S is provided with a reinforcing frame, generally designated 316, arranged interiorly of the main frame comprising the aforesaid top 40, bottom 42, and side 44 frame members. Each spandrel unit reinforcing frame 316 comprises a top reinforcing frame member 318, bottom reinforcing frame member 320, and pair of side reinforcing frame members 322, all combined into rectangular arrangement. All the reinforcing frame members 318, 320 and 322 are preferably made of steel and channel sectioned, opening interiorly. The top 318 and bottom 320 reinforcing frame members are both shown on an enlarged scale in FIG. 6, and the pair of side reinforcing frame members 322 in FIG. 7.

With reference to FIG. 6 the top reinforcing frame member 318 is secured to the top frame member 40 of the spandrel unit S by bolts 324 having their heads engaged in the undercut groove 252. The bottom reinforcing frame member 320 is secured to the spandrel unit bottom frame member 42 by bolts 326 having their heads engaged in the undercut groove 264. It will also be seen from FIG. 7 that the pair of side reinforcing frame members 322 are secured to the respective spandrel unit side frame members 44 by bolts 328 having their heads engaged in the undercut grooves 282.

Figure 9:
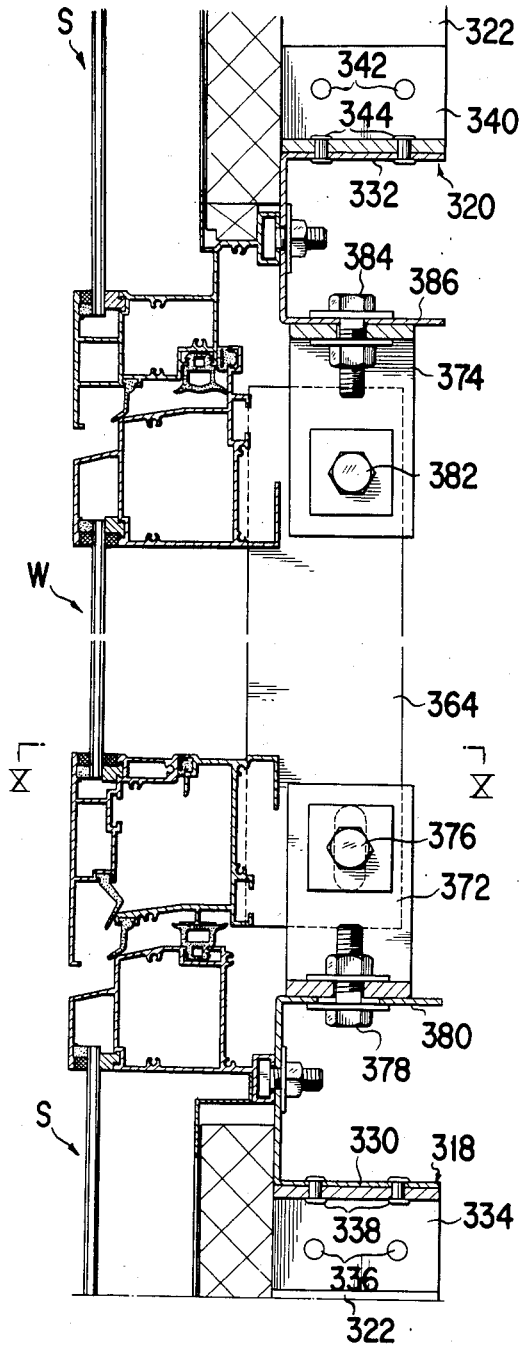
FIG. 9 is an enlarged vertical section, partly broken away for illustrative convenience, through the curtain wall assembly, taken along the line IX—IX in FIG. 1 and showing in particular the means for joining together the reinforcements of the window and spandrel units.

As will be understood from a study of FIGS. 8 and 9, each side reinforcing frame member 322 has its opposite ends in abutting contact with a bottom flange 330 of the top reinforcing frame member 318 and with a top flange 332 of the bottom reinforcing frame member 320. An L shaped connector 334 is rivetted or otherwise fastened as at 336 to each side reinforcing frame member 322 and as at 338 to the top reinforcing frame member 318. Another L shaped connector 340 is likewise rivetted or otherwise fastened as at 342 to each side reinforcing frame member 322 and as at 344 to the bottom reinforcing frame member 320.

The spandrel unit reinforcing frame 316 is used also for supporting the pair of refractory boards 50. As will be noted from FIG. 6, each refractory board 50 has its upper peripheral portion engaged between a web 346 of the top reinforcing frame member 318 and a flange 348 fastened to the spandrel unit top frame member 40. The lower peripheral portion of each refractory board 50 is engaged between a web 350 of the bottom reinforcing frame member 320 and a flange 352 formed integral with the spandrel unit bottom frame member 42. Further, as shown in FIG. 7, each refractory board 50 has one of its opposite lateral marginal portions engaged between a web 354 of one of the side reinforcing frame members 322 and a flange 356 fastened to one of the spandrel unit side frame members 44. The other lateral marginal portion of each refractory board 50 is engaged between the interior flange 292 and exterior frame portion 294 of the spandrel unit mullion 46.

The reinforcements for the spandrel unit S further comprises a pair of vertical reinforcing members 358 seen in both FIGS. 7 and 8. Each in the shape of a flat, relatively thick strip, the vertical reinforcing members 358 are screwed or otherwise fastened at 360 to the outer surfaces of the outer flanges 362 of the pair of side reinforcing frame members 322, respectively. The vertical reinforcing members 358 serve to impart additional rigidity to the spandrel unit S in its vertical direction. Attached sidewise to the side reinforcing frame members 322, arranged interiorly of the spandrel unit S, the vertical reinforcing members 358 do not prevent the sealing of the joints between the adjoining spandrel units, as will be understood from FIG. 7.

Window Unit Reinforcements

Being not directly coupled to the floor systems in accordance with our invention, the window units W are also in need of effective reinforcement. Toward this end we provide reinforcing studs 364 seen in FIGS. 4, 5, 8, 9 and 10. Each in the form of a flat strip, the reinforcing studs 364 are arranged vertically one between the opposed outer walls 122 of the side frame members 28 of each horizontally neighboring pair of window units W.

As will be observed from FIGS. 4, 5 and 8, each reinforcing stud 364 has a plurality of vertically elongate slots 366 formed therein vertically or longitudinally spaced apart positions thereon. Bolts 368 extend through these slots 366 in each reinforcing stud 364 and further through holes in the associated pair of opposed outer walls 122 of the side frame members 28 of two adjacent window units W. Nuts 370 are fitted one over the threaded end of each bolt 368. The bolts 368 with the nuts 370 serve not only to connect the reinforcing studs 364 to the side frame members 28 of the window units W but also to fasten the horizontally adjoining window units to each other.

Figure 10:
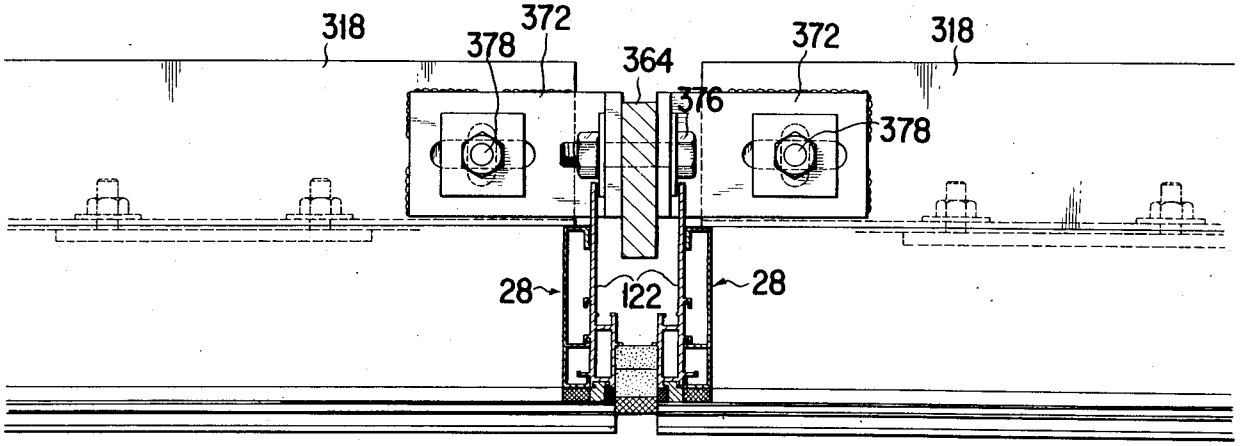
FIG. 10 is a horizontal section taken along the line X—X in FIG. 9 and showing the means for connecting the bottom end of each window unit reinforcing stud to the reinforcing frames of two neighboring spandrel units.

FIGS. 8, 9 and 10 further indicate that each reinforcing stud 364 has its bottom end secured to the top reinforcing frame members 318 of the two underlying spandrel units S by a pair of L shaped connectors 372, and its top end secured to the bottom reinforcing frame members 320 of the two overlying spandrel units S by another pair of L shaped connectors 374. The first recited pair of connectors 372 are shown in detail in both FIGS. 9 and 10. These connectors are fastened by a bolt 376 to the opposite surfaces of each reinforcing stud 364 at its bottom end. The first pair of connectors 372 are further fastened by bolts 378 to the top flanges 380 of the top reinforcing frame members 318 of two neighboring spandrel units S. It will likewise be understood from FIG. 9 that the second pair of L shaped connectors 374, one seen, are fastened by a bolt 382 of the opposite surfaces of the reinforcing stud 364 at its top end, and by bolts 384 to the bottom flanges 386 of the bottom reinforcing frame members 320 of two neighboring spandrel units S.

It is thus seen that each reinforcing stud 364 has its opposite ends bolted to the reinforcing frames 316 of the two spandrel units S underlying the two window units W to which the reinforcing stud is bolted laterally at 368, and to the reinforcing frames of the two spandrel units overlying the two window units in question.

Preferably, and as shown in FIGS. 4 and 5, each reinforcing stud 364 is enclosed in a stud cover 388 arranged interiorly of the side frame members 28 of the window units W. Each stud cover 388 is longitudinally split into a pair of interfitting segments 390 and 392.

With particular reference to FIG. 4, the right hand segment 390 of each stud cover 388 comprises a wall 392 disposed interiorly of the inner wall 120 of one window unit side frame member 28 approximately in a coplanar relation therewith, and another wall 396 bent right angularly from the interior edge of the wall 392 toward the left hand stud cover segment 392. The wall 396 defines a groove 398 along its outer edge opposite the left hand stud cover segment 392. The left hand stud cover segment 392 likewise comprises a wall 400 disposed interiorly of the inner wall 120 of the next window unit side frame member 28 approximately in a coplanar relation therewith, and another wall 402 bent right angularly from the interior edge of the wall 400 toward the right hand stud cover segment 390. The wall 402 of the left hand stud cover segment 392 has a tongue 404 engageable in the groove 398 in the right hand stud cover segment 390, and an L shaped mounting flange 406 disposed exteriorly of the tongue 404.

The left hand stud cover segment 392 is mounted in place by having its mounting flange 406 screwed at 408 to a flange 410 of each reinforcing stud 364. The right hand stud cover segment 390 is engaged with the left hand stud cover segment 392 by receiving its tongue 404 in the groove 398. The stud covers 388 are joined to the top and bottom window stools 82 and 94, FIG. 3, of the window unit W.

Connections between Spandrel Units and Window Units

As has been mentioned in conjunction with FIGS. 1 and 2, each spandrel unit S is coupled to the overlying window unit W by the connector means 58 and to the underlying window unit by the connector means 60. Both connector means 58 and 60 are shown in greater detail in FIGS. 3 and 6.

The connector means 58 between each spandrel unit S and the overlying window unit W comprises three horizontally spaced apart, L shaped connectors 412 each bolted at 414 to the top flange 380 at the top reinforcing frame member 318 of the spandrel unit S. Each connector 412 is further fastened to the bottom frame member 26 of the overlying window unit W by a bolt 416 having its head engaged in the undercut groove 92 defined by the interior wall 84 of the window unit bottom frame member.

The connector means 60 between each spandrel unit S and the underlying window unit W likewise comprises three horizontally spaced apart, L shaped connectors 418 each bolted at 420 to the bottom flange 386 of the spandrel unit bottom reinforcing frame member 320. Each connector 418 is further fastened to the top frame member 24 of the underlying window unit W by a bolt 422 having its head engaged in the undercut groove 74 defined by the interior wall 62 of the window unit top frame member.

Spandrel Unit Mounting Means

A reconsideration of FIGS. 1 and 2 will reveal that each row of spandrel units S are connected to the top of the slab 22 of one floor system F by the upper mounting means 52, and to the bottom of the slab 22 by the lower mounting means 54. We have illustrated these mounting means 52 and 54 in further detail in FIGS. 7, 8, 11 and 12.

Figure 11:
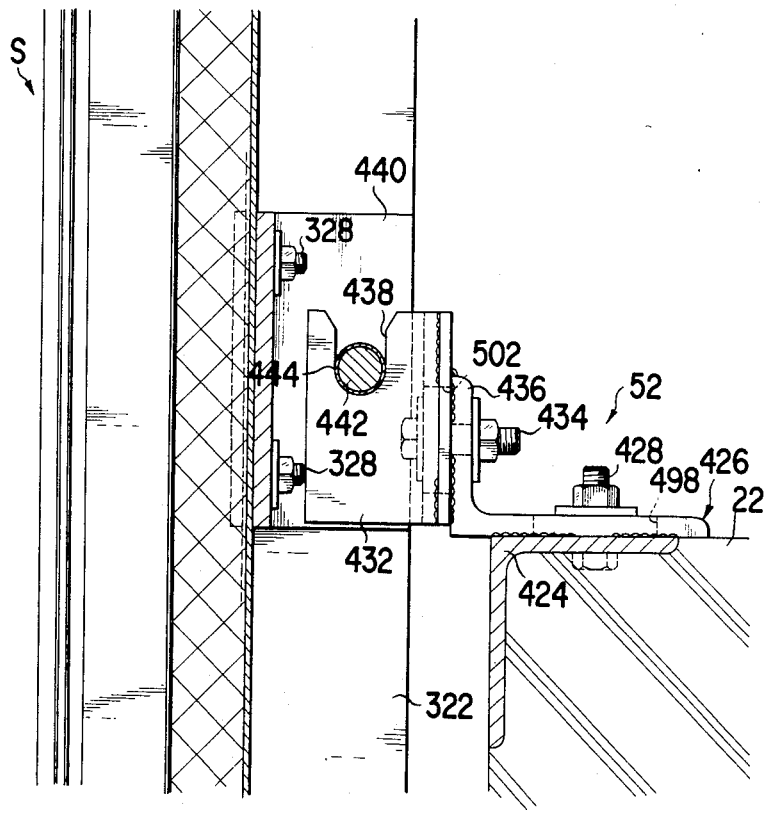
FIG. 11 is a vertical section taken along the line XI—XI in FIG. 7 and showing in particular the upper mounting means for mounting the spandrel units to the floor structure of the building.

We will first describe the upper mounting means 52 with reference to FIGS. 7, 8 and 11. Included is an L shaped slab reinforcement 424 suitably secured to the slab 22 to cover and reinforce its upper, exterior edge. A plurality of L shaped connectors 426 are bolted at 428 to the slab 22 via the slab reinforcement 424. Each connector 426 is used for jointly connecting the side reinforcing frame members 322 of two horizontally adjoining spandrel units S to the slab 22, as will be understood from FIGS. 7 and 8. A rib 430 is provided centrally of each connector 426 by way of reinforcement. A pair of L shaped brackets 432 are bolted at 434 to the upstanding portion 436 of each connector 426. Each bracket 432 has formed therein a notch 438 opening upwardly.

The upper mounting means 52 further comprise a clevis 440 engaged in each side reinforcing frame member 322 of the spandrel units S, in a position somewhat closer to its top end. All the clevises 440 are in horizontal alignment and are secured to the spandrel unit side reinforcement frame members 322 by the same bolts 328 fastening these side reinforcing frame members to the spandrel unit side frame members 44, and by the same bolts 360 fastening the spandrel unit vertical reinforcing members 358 to the side reinforcing frame members. Each clevis 440 rigidly supports a pin 442 extending horizontally and parallel to the plane of the spandrel units S. A low-friction sleeve 444 of Teflon (trademark) or like material is fitted over each pin 442.

The pins 442 rigidly connected to the spandrel units S are engaged in the notches 438 in the brackets 432 rigidly connected to the slab 22. The low-friction sleeves 444 on the pins 442 are intended to allow relative displacement of the pins 442 and the brackets 432 in the plane of the curtain wall assembly 20.

Figure 12:
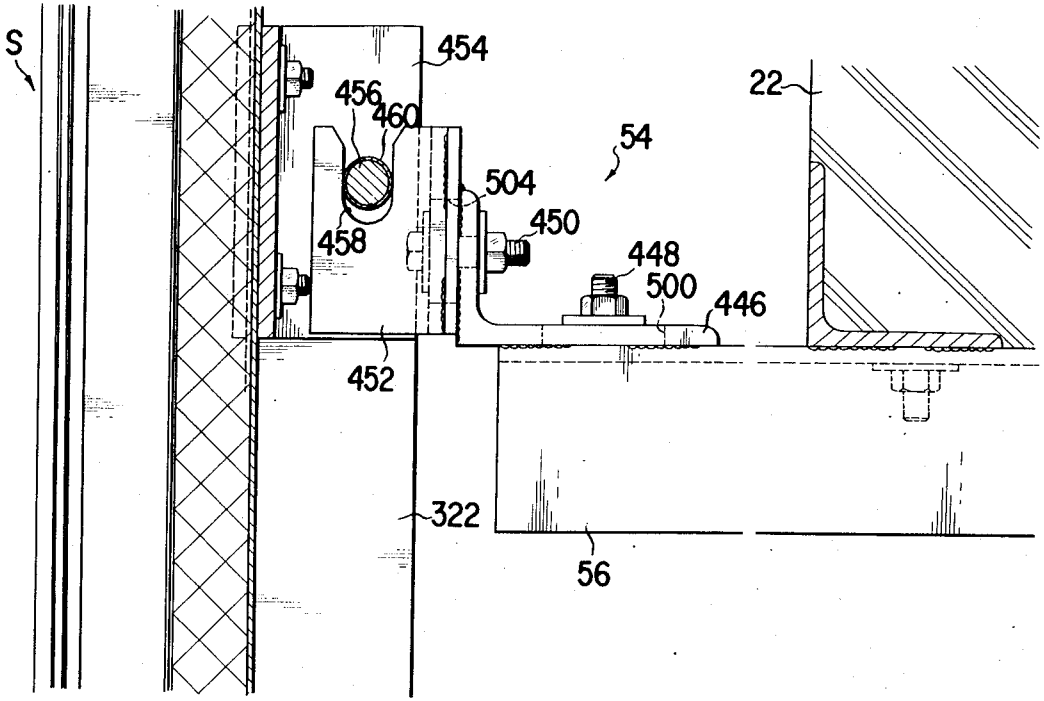
FIG. 12 is a vertical sectional view showing the lower mounting means for mounting the spandrel units to the floor structure of the building.

As will be noted from FIGS. 8 and 12, the lower mounting means 54 are of like construction, including L shaped connectors 446 each bolted at 448 to the exterior extension 56 of the slab 22 and at 450 to a pair of brackets 452. Clevises 454 are engaged one in each spandrel unit side reinforcing frame member 322 and fastened thereto, in a position adjacent the bottom end thereof. Pins 456 rigidly supported by the clevises 454 are engaged in notches 458 in the brackets 452 via low-friction sleeves 460 of Teflon or the like fitted over the pins.

With the upper 52 and lower 54 mounting means constructed as in the foregoing, it will be seen that the pins 442 of the upper mounting means are engaged in and bottomed against the notches 438 in the brackets 432, as pictured in FIG. 11, thereby bearing the weight of the spandrel units S against the slab 22. The pins 456 of the lower mounting means 54, on the other hand, are engaged in the notches 458 in the bracket 452 to an extent depicted in FIG. 12, locking the spandrel units S against displacement out of their normal vertical plane. Thus the mounting means 52 and 54 coact to mount the spandrel units S, as well as the window units W connected thereto, to the slab 22 against the possibility of displacement of any direction.

Seals between Window and Spandrel Units

With reference to FIG. 5, the joints between the side frame members 28 of the window units W are each sealed by a sealing strip 462 of U shaped cross section. Each sealing strip 462 has a pair of thickened opposite longitudinal edges engaged in the interiorly open grooves 126 defined by the outer walls 122 of the window unit side frame members 28. Additionally, an adhesive of relatively high elasticity such as a silicone sealant joins at 464 the outer walls 122 of the neighboring window unit side frame members 28 via backing strips 466 of sponge or like elastic material.

As illustrated in FIG. 7, backing strips 468 of sponge or like elastic material are interposed between the flanges 286 of the side frame members 44 of the neighboring spandrel units S. On the exterior side of these backing strips 468, an adhesive of relatively high elasticity joints at 470 the outer side edges 304 of the panels 48 of the neighboring spandrel units S.

We have stated with reference to FIG. 6 that each spandrel unit S has the sealing strip 244 on its top frame member 40 and the sealing strip 272 on its bottom frame member 42, and with reference to FIG. 7 that each spandrel unit has the pair of sealing strips 290 on its side frame members 44. All these sealing strips 244, 272 and 290 are of identical make and are joined to one another into a substantially continuous strip of rectangular arrangement extending along the main frame (comprising the frame members 40, 42 and 44) of each spandel unit S.

Figure 13:
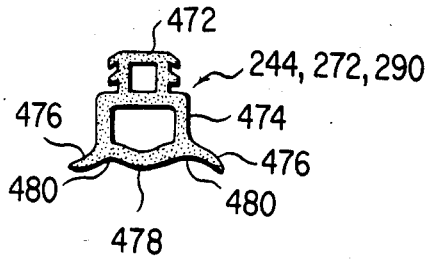
FIG. 13 is a cross sectional representation of some sealing strips used in the curtain wall assembly of FIG. 1.

FIG. 13 is a cross sectional representation of the sealing strips 244, 272 and 290. Each sealing strip comprises a hollow mounting base 472 to be engaged in the undercut groove 242, 270 or 288 in the spandrel unit frame member 40, 42 or 44, a hollow body part 474, and a pair of divergent fins 476 extending generally away from each other from the end of the body part away from the mounting base. The body part 474 has a convex wall 478 between the pair of fins 476, defining in combination with these fins a pair of concavities 480 on the opposite sides of the convex wall.

Figure 14:
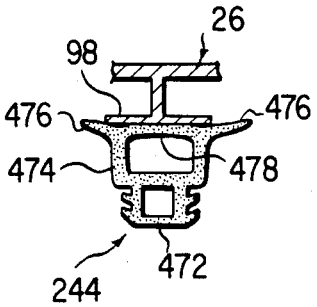
FIG. 14 is a cross sectional illustration of the way in which one of the sealing strips of FIG. 13 makes sealing engagement with an abutment member.

Thus, as the sealing strip 244 of the above configuration has its mounting base 472 engaged in the groove 242 in the spandrel unit top frame member 40 as shown in FIG. 6, the convex wall 478 of the sealing strip is pressed against the abutment 98 of the overlying window unit bottom frame member 26. As illustrated on an enlarged scale in FIG. 14, the abutment 98 has a width slightly greater than that of the convex wall 478 of the sealing strip 244. Accordingly, not only the convex wall 478 but also the pair of divergent fins 476 of the sealing strip 244 are pressed against the abutment 98, thereby positively sealing the joint between each spandrel unit top frame member 40 and the overlying window unit bottom frame member 26.

Referring back to FIG. 6, it will be noted that the sealing strip 100 is disposed exteriorly of the sealing strip 244, with the sealing strip 100 being proximally mounted to the window unit bottom frame member 26 and having an angled distal portion 482 held against the corner 246 of the spandrel unit top frame member 40. An enclosed space 484 is thus defined between window unit bottom frame member 26 and spandrel unit top frame member 40. FIG. 6 also shows that, mounted to the spandrel unit bottom frame member 42, the sealing strip 272 has one of its fins 476 pressed against the upward extension 70 of the interior wall 62 of the window unit top frame member 24. Lying exteriorly of this sealing strip 272, the other sealing strip 274 on the spandrel unit bottom frame member 42 has its angled distal portion 486 held against the corner 76 of the window unit top frame member 24. An enclosed space 488 is thus defined between spandrel unit bottom frame member 42 and window unit top frame member 24.

As will be understood from FIG. 7, the sealing strip 290 on each spandrel unit side frame member 44 butts on the sealing strip 290 on the neighboring spandrel unit side frame member 44. These butting sealing strips 290 have their convex walls 478 and divergent fins 476 pressed against each other, thereby creating a pair of cavities 490 therebetween. We have mentioned that the spandrel units S have their panels 48 joined to one another by the adhesive 470 via the backing strips 468. There is accordingly defined an enclosed space 492 between any two adjoining spandrel units S.

It will have been seen that each spandrel unit S is surrounded by the upper enclosed space 484 (FIG. 6), lower enclosed space 488, and pair of lateral enclosed spaces 492 (FIG. 7). All these enclosed spaces are continuous. Further, as will be seen from FIG. 6, the exterior sealing strips 100 and 274 have apertures 494 and 496, respectively, through which the continuous enclosed spaces 484, 488 and 492 communicate with atmosphere for a more effective sealing of the joints between the spandrel units S and between the spandrel units and the window units W. The exterior sealing strips 100 and 274 offer an additional advantage as their angled distal portions 482 and 486 make contact with the corner 246 of the spandrel unit top frame member 40 and with the corner 76 of the window unit top frame member 24, respectively, in the middle of their transverse dimension and project exteriorly and downwardly beyond the corners 246 and 76. These projecting portions of the exterior sealing strips 100 and 274 function as water drips, effectively preventing the intrusion of rainwater.

Manner of Mounting and Assemblage

For the installation of the curtain wall assembly 20, the spandrel units S are first mounted to the slabs 22 of the building, and then the window units W are connected between the rows of spandrel units. It is understood that the spandrel units S, inclusive of their reinforcing frames, and the window units W are both prefabricated. We will first explain how to mount the prefabricated spandrel units S.

The L shaped connectors 426 and 446 of the upper 52 and lower 54 mounting means are first fastened to each slab 22 via the slab reinforcement 424 and slab extension 56 by the bolts 428 and 448, respectively. As will be noted from FIGS. 11 and 12, the L shaped connectors 426 and 446 have slots 498 and 500, respectively, for the passage of the bolts 428 and 448. Therefore, before tightening the nuts on the bolts 428 and 448, the L shaped connectors 426 and 446 may be moved relative to the slab 22 in a direction normal to the plane of the curtain wall assembly 20 for the adjustment of their positions in that direction.

Then the brackets 432 and 452 are fastened to the L shaped connectors 426 and 446 by the bolts 434 and 450, respectively. It will also be observed from FIGS. 11 and 12 that the connectors 426 and 446 have vertically elongated slots 502 and 504, respectively, for the passage of the bolts 434 and 450. The vertical positions of the brackets 432 and 452 are therefore also adjustable relative to the slab 22.

It is understood that the clevises 440 and 454 with the pins 442 and 456 have already been mounted in places on the side reinforcing frame members 322 of the spandrel units S. After bolting the brackets 432 and 452 to the respective L shaped connectors 426 and 446 as above, the spandrel units S may be successively mounted to the slab 22 by engaging the pins 442 and 456 in the notches 438 and 458 in the brackets 432 and 452, respectively. The pins 442 and 456 have the low-friction sleeves 444 and 460 for sliding engagement with the brackets 432 and 452. Consequently, the spandrel units S are readily slidable horizontally in their own plane with respect to one another for the adjustment of their relative positions in that direction. The sealing strips 290 on the side frame members 44 of the spandrel units S will make proper sealing engagement with each other, as shown in FIG. 7, upon correct adjustment of the relative horizontal positions of the spandrel units.

Next comes the step of connecting the window units W between the rows of spandrel units S that have been mounted to the respective slabs 22 in the above described manner. The window units W to be mounted may previously be placed upon the slabs of the floor systems as the window units can be connected between the spandrel units S from within the building.

The L shaped connectors 58 and 60, best seen in FIGS. 3 and 6, are used for the connection of the window units W between the spandrel units S. The connectors 58 and 60 are fastened to the top 318 and bottom 320 reinforcing frame members of the spandrel units S by the bolts 414 and 420, respectively, and to the bottom 26 and top 24 frame members of the window units S by the bolts 416 and 422, respectively. FIGS. 3 and 6 indicate that the connectors 58 and 60 have vertically elongate slots 506 and 508 for the passage of the bolts 416 and 422 respectively. Thus the positions of the window units W are adjustably variable vertically with respect to the spandrel units S for the proper sealing of the joints therebetween by the interior sealing strips 244 and 272 and exterior sealing strips 100 and 274.

Then, as illustrated in FIG. 7, the opposed outer edges of the panels 48 of the neighboring spandrel units S are secured to each other by the adhesive 470 of relatively high elasticity with the aid of the backing strips 468 of sponge of the like mounted between the flanges 286 of the spandrel unit side frame members 44. The opposed side frame members 28 of the adjoining window units W are likewise secured to each other, as in FIG. 5, by the adhesive 464 with the aid of the backing strips 466 caught between the outer surfaces 198 of the window unit side frame members.

The next step is the mounting of the reinforcing studs 364 for the reinforcement of the window units W and for the more rigid connection of the window units to the spandrel units S. Placed between the opposed outer walls 122 of the side frame members 28 of every two neighboring window units W, each reinforcing stud 364 has its bottom end fastened to the top reinforcing frame members 318 of the two underlying spandrel units S by the pair of connectors 372, and its top end fastened to the bottom reinforcing frame members 320 of the two overlying spandrel units S by the pair of connectors 374. Each reinforcing stud 365 is further secured to the opposed outer walls 122 of the neighboring window unit side frame members 28 by the bolts 368 passing the vertically elongate slots 366 in the reinforcing stud.

Thus reinforced and rigidly coupled to the overlying and underlying spandrel units S, the window units W can withstand to a greater extent than heretofore the forces that may be exerted thereon in a direction normal to their plane, even though the window units are not directly coupled to the floor systems. The slots 366 are intended to allow some vertical displacement of the window units W.

Then the top 82 and bottom 94 window stools (FIG. 3) and stud cover segments 390 and 392 (FIGS. 4 and 5) of each window unit W are combined rectangularly and mounted interiorly to the frame members 24, 26 and 28 of the window unit. As will be seen by referring again to FIG. 4, the mounting flange 406 of the stud cover segment 392 is screwed at 408 to one of the reinforcing studs 364. Upon mounting of each set of window stools 82 and 94 and stud cover segments 390 and 392 to one window unit W, the next set of window stools and stud cover segments may be mounted to the next window unit with the groove 398 of the stud cover segment 390 engaged with the tongue 404 of the stud cover segment 392 of the previously mounted set. This interfitting engagement of the stud cover segments 390 and 392 makes it possible to previously join each set of stud cover segments and window stools 82 and 94 into rectangular shape and then to mount the set in place on one window unit, thereby realizing efficiency in assemblage. Besides concealing the reinforcing studs 364, the interfitting stud cover segments 390 and 392 are well calculated to allow the relative displacement of the window units W, as their grooves 398 and tongues 404 are somewhat loosely interengaged.

Figure 15:
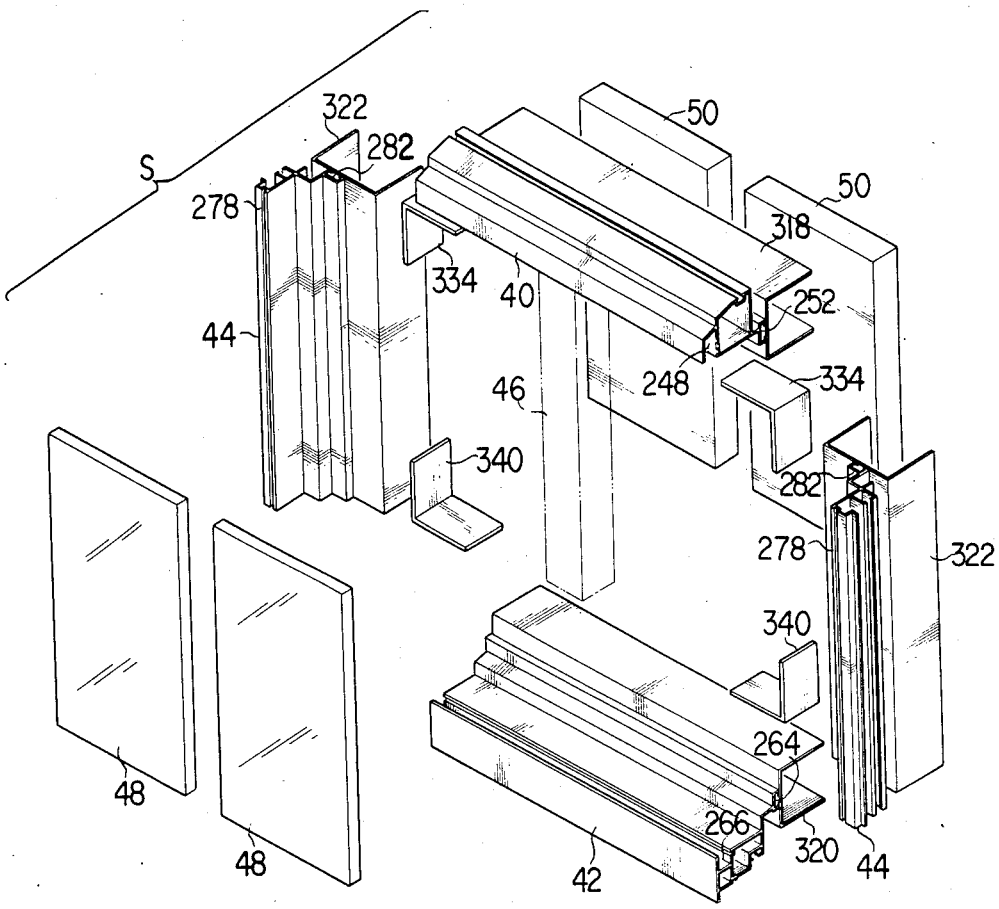
FIG. 15 is an exploded perspective view of each spandrel unit of the curtain wall assembly of FIG. 1.

The mounting and assemblage of the curtain wall assembly 20 is now completed. We will now briefly explain how to assemble each spandrel unit S. For an easier understanding of the following explanation, reference may be had to FIG. 15 which shows the spandrel unit S in exploded perspective, in addition to other figures to which we will refer in the course of such explanation.

The pair of side frame members 44 are held endwise between the opposite ends of the top 40 and bottom 42 frame members and screwed thereto to form the rectangular main frame. In thus combining the spandrel unit frame members, care should be taken so that the downwardly open gap 248 in the top frame member 40 and the upwardly open gap 266 in the bottom frame member 42 come exteriorly of the exterior flanges 278 of the side frame members 44. In the case of the illustrated embodiment, the mullion 46 is connected between the top 40 and 42 frame members in a position midway between the pair of side frame members 44. As will be noted from FIG. 7, the exterior wall 298 of the mullion 46 is in a coplanar relation with the exterior flanges 278 of the side frame members 44.

Then the reinforcing frame members 318, 320 and 322 are combined rectangular and joined to one another by the L shaped connectors 334 and 340. Then the reinforcing frame is fastened to the main frame by the bolts 324 (FIG. 6), 326 (FIG. 6) and 328 (FIG. 7) having their heads engaged in the interiorly open, undercut grooves 252, 264 and 282 in the main frame members 40, 42 and 44, respectively.

Then the pair of refractory boards 50 are mounted. An inspection of FIGS. 6 and 7 will show that the mounting flanges 348 and 356 for the refractory boards 50 are screwed at 510 and 512 to the top frame member 40 and side frame members 44, respectively, whereas the mounting flange 352 is integral with the bottom frame member 42. Thus, before screwing these separate mounting flanges 348 and 356, each refractory board 50 has its lower marginal portion engaged between the mounting flange 352 and the web 350 of the bottom reinforcing frame member 320 via a rest or rests 514. FIG. 6, and one of its lateral marginal portions engaged between the interior flange 292 and exterior frame 294 of the mullion 46. Then the mounting flanges 348 and 356 are screwed at 510 and 512 to the top frame member 40 and side frame members 44, respectively, thereby completing the mounting of the refractory boards 50.

Then the pair of panels 48 are mounted, each by having its top and bottom marginal portions engaged in the downwardly open gap 248 in the top frame member 40 and in the upwardly open gap 266 in the bottom frame members 42, as best seen in FIG. 6. Further, held against the stuffing strips 284 and 300, FIG. 7, the lateral marginal portions of each panel 48 is secured to one of the side frame members 44 and the mullion 46 by the adhesive 302. The assemblage of the spandrel unit S is now completed.

The above described method of assembling the spandrel unit S is notable for the ease with which the panels 48 and refractory boards 50 are mounted to the main and reinforcing frames. As the rectangular main frame comprising the frame members 40 and 42 and 44 is combined with the rectangular reinforcing frame comprising the reinforcing frame members 318, 320 and 322, the combined main and reinforcing frames may be placed horizontally, with the main frame overlying the reinforcing frame. Then the refractory boards 50 and panels 48 may be attached successively to the main and reinforcing frames from above.

In order to make this manner of assemblage possible, we have made the inside dimensions of the reinforcing frame less than those of the main frame, and the total size of the two refractory boards 50 more than the inside dimensions of the reinforcing frame and less than the inside dimensions of the main frame, as will be best understood from a study of FIGS. 6 and 7. Further, in the illustrated embodiment, the pair of refractory boards 15 are each smaller in size than one of the rectangular spaces bounded by the top 40 and bottom 42 frame members, side frame members 44, and mullion 46, so that the refractory boards can be mounted through these spaces in the above described manner.

Although we have shown and described the prefabricated curtain wall assembly of our invention in terms of but one embodiment thereof, we wish to have it understood that this embodiment is meant purely to illustrate or explain and not to impose limitations upon our invention. For instance, the division of each window unit W into the fixed window section W1 and openable window section W2 is not of absolute necessity, and neither is the provision of the mullions 32 and 36. Nor is the provision of the mullion 46 of each spandrel unit S a requirement. Thus, in its simplest form, each of the window units W and spandrel units S has but one panel, and each spandrel unit may additionally comprise but one refractory board.

We claim:

1. A prefabricated curtain wall assembly for a building having floor systems, comprising:

(a) a plurality of spandrel units to be mounted to each floor system of the building in side by side relationship with one another, each spandrel unit including a panel and generally rectangular frame means supporting the panel;

(b) a plurality of window units to be connected one between two vertically adjoining ones of the spandrel units, each window unit including a second panel and generally rectangular frame means supporting the second panel, the frame means of each window unit including a pair of opposite side frame members extending vertically; and (c) a plurality of reinforcing studs each to be arranged vertically between any two horizontally adjoining ones of the window units and coupled to the opposed side frame members thereof, each reinforcing stud further having its opposite ends adapted to be rigidly anchored respectively to the frame means of the spandrel units underlying the two window units associated with the reinforcing stud, and to the frame means of the spandrel units overlying the two window units associated with the reinforcing stud, (d) whereby only the spandrel units are coupled directly to the floor systems of the building whereas the window units are firmly supported by the spandrel units via the reinforcing studs.

2. The prefabricated curtain wall assembly of claim 1 wherein the frame means of each spandrel unit comprises a main frame having the first recited panel attached thereto, and a reinforcing frame arranged interiorly of the main frame and secured thereto, and wherein each reinforcing stud has its opposite ends adapted to be anchored to the reinforcing frames of the associated spandrel units.

3. The prefabricated curtain wall assembly of claim 2 wherein each reinforcing stud is in the shape of a flat strip, and wherein the curtain wall assembly further comprises connector means for connecting each end of each reinforcing stud to the reinforcing frames of the two associated spandrel units, the connector means comprising a pair of L shaped connectors rigidly fastened to the opposite surfaces of each reinforcing stud at one end thereof and to the respective reinforcing frames of the two associated spandrel units.

4. The prefabricated curtain wall assembly of claim 2 wherein the reinforcing frame of each spandrel unit comprises a top reinforcing frame member, bottom reinforcing frame member, and pair of side reinforcing frame members of rectangular arrangement, and wherein the pair of side reinforcing frame members of each spandrel unit are each further provided with a vertical reinforcing member to be secured thereto.

5. The prefabricated curtain wall assembly of claim 4 wherein the top, bottom, and side reinforcing frame members of each spandrel unit are each channel shaped and are open interiorly, and wherein each vertical reinforcing member is in the shape of a flat strip secured to the outer surface of one side reinforcing frame member.

6. The prefabricated curtain wall assembly of claim 1 wherein each side frame member of each window unit includes an outer wall opposed to a similar outer wall of the neighboring window unit, and wherein each reinforcing stud is in the form of a flat strip and is disposed between the opposed outer walls of any two horizontally adjoining window units and are coupled thereto by a plurality of vertically spaced apart fastener elements extending through the reinforcing stud and the outer walls.

7. The prefabricated curtain wall assembly of claim 6 wherein each reinforcing stud has a plurality of vertically elongated slots formed therein for the passage of the respective fastener elements whereby the window units are vertically displaceable within limits relative to the reinforcing studs.

8. The prefabricated curtain wall assembly of claim 1 further comprising a stud cover for interiorly covering each reinforcing stud.

9. The prefabricated curtain wall assembly of claim 8 wherein each stud cover is longitudinally split into a pair of interfitting segments, one segment of each stud cover being adapted to be coupled to one reinforcing stud.

* * * * *